United States Patent [19]

Kurihara

[11] 4,379,486

[45] Apr. 12, 1983

[54] HEAT EXCHANGER

[75] Inventor: Tetsuo Kurihara, Utsunomiya, Japan

[73] Assignee: Fuji Jukogyo Kabushiki Kaisha, Tokyo, Japan

[21] Appl. No.: 173,223

[22] Filed: Jul. 28, 1980

[30] Foreign Application Priority Data

Aug. 3, 1979 [JP] Japan ..... 54-99191

[51] Int. Cl.[3] ..... F28F 3/00

[52] U.S. Cl. ..... 165/153; 165/166; 62/525

[58] Field of Search ..... 165/148–153, 165/157, 166, 167; 62/525

[56] References Cited

U.S. PATENT DOCUMENTS

| | | | |
|---|---|---|---|
| 2,392,444 | 1/1946 | Amand et al. | 165/167 X |
| 2,686,654 | 8/1954 | MacNeill | 165/166 X |
| 3,241,607 | 3/1966 | Rutledge | 165/166 |
| 4,002,201 | 1/1977 | Donaldson | 165/166 X |
| 4,006,776 | 2/1977 | Pfouts et al. | 165/166 |
| 4,274,482 | 6/1981 | Sonoda | 63/525 |

*Primary Examiner*—William R. Cline
*Assistant Examiner*—Theophil W. Streule, Jr.
*Attorney, Agent, or Firm*—Martin A. Farber

[57] ABSTRACT

A heat exchanger comprises a plurality of layered units of tube assemblies, each tube assembly unit comprising a tube made by two plates having a refrigerant inlet opening and a refrigerant outlet opening, and a spacer block is disposed between the upper and lower tube assemblies for forming an air passage having an air inlet side and an air outlet side. The refrigerant inlet opening is provided in the lower plate of the tube adjacent the air inlet side. The upper and lower tube assembly units are alternately arranged with respect to the refrigerant inlet and outlet openings. The spacer block has an opening for communicating the refrigerant outlet opening of the lower tube assembly unit with the refrigerant inlet opening of the upper tube assembly unit, such that the refrigerant mainly flows in a portion in the tube adjacent the air inlet side.

12 Claims, 8 Drawing Figures

FIG. 1
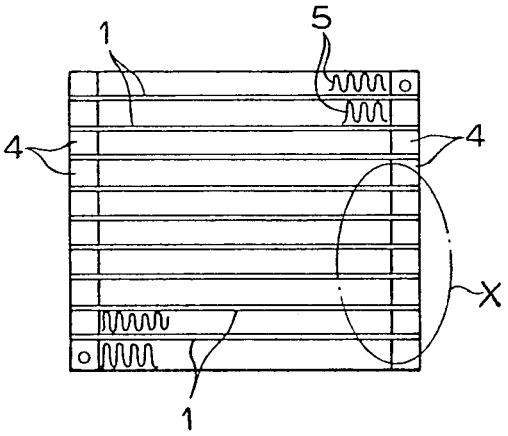
PRIOR ART
FIG. 2
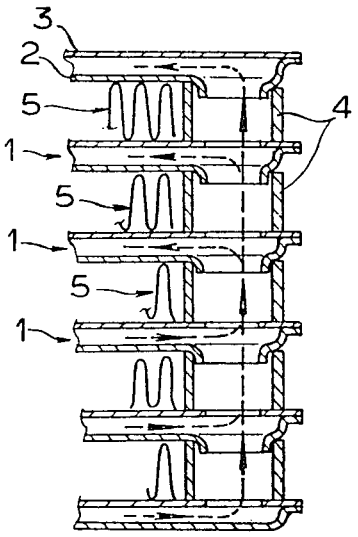
PRIOR ART
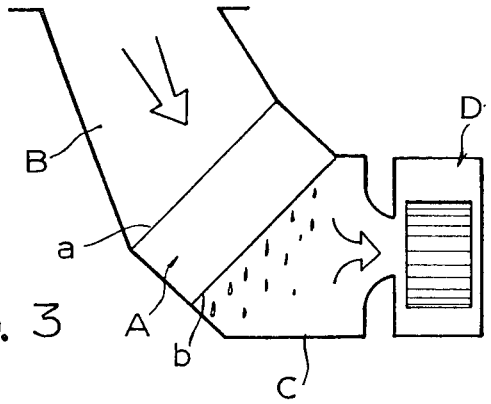
FIG. 3

HEAT EXCHANGER

BACKGROUND OF THE INVENTION

This invention relates to a heat exchanger of integral layered plate-fin type.

A heat exchanger of an integral layered plate-fin type as shown in FIGS. 1 and 2 is constructed by a plurality of flat hollow tubes 1 each of which is made by two metal plates 2 and 3, spacer-blocks 4 interposed between each pair of adjacent tubes 1 to form a layer of tubes, and heat conduction fins 5 disposed in respective spaces defined by the spacer-blocks 4 and the tubes 1 and these parts are assembled by integrally brazing them together. This type of heat exchanger has already been broadly used as a condenser for vapor compression air conditioning systems generaly used as an automobile cooler, a room cooler and the like.

This kind of heat exchanger is advantageous when it is used as an evaporator for air conditioning systems because its heat transfer efficiency is much higher than a usual fin-tube type heat exchanger. However, on the other hand, it is necessary to locate the evaporator A at an angle with with respect to the horizontal in a duct B as shown in FIG. 3, so that the dew derived from the air introduced by means of a fan D and formed on the outer surface of the evaporator may quickly drop into a drain-pan C.

Considering the draining function and space of installation of the evaporator, it is preferable to set the tilting angle to about 45°. But when the heat exchanger of integral layered plate-fin type is tilted, the refrigerant with two phases, i.e., gas and liquid phases, flowing through each tube as indicated by arrows in FIG. 2 is separated as shown in FIG. 4. Gaseous refrigerant gathers in the air inlet side (a) of each tube 1 and liquid refrigerant gathers in the air outlet side (b) as shown in FIG. 4, under the influence of gravity and of the difference between the specific gravities of the liquid and the gas. Such a flow condition decreases the heat transfer efficiency of the heat exchanger. More particularly, under the condition of gas-liquid distribution in tubes 1 as shown in FIG. 4, when the room temperature is high, the temperature difference between the air temperature and the temperature of the gaseous refrigerant at the air inlet side of the evaporator is smaller than the difference between the air temperature and the temperature of the liquid refrigerant, causing a lowered heat exchange efficiency. When the room temperature is relatively low, the evaporation pressure is decreased and the deviation of the liquid refrigerant in the air-outlet side (b) is increased, which cause the inconvenience of frosting in the air-outlet side (b).

Because of these problems, it has been considered difficult to adopt the heat exchanger of the integral layered plate-fin type as an evaporator.

SUMMARY OF THE INVENTION

Accordingly, it is an object of the present invention to provide a heat exchanger of the integral layered plate-fin type in which the gas-liquid distribution of the refrigerant in tilted tubes is maintained in the condition of the high heat exchange efficiency.

BRIEF DESCRIPTION OF DRAWINGS

FIG. 1 is a front sectional view of a conventional heat exchanger of integral layered plate-fin type, FIG. 2 is a enlarged view of the X-portion of the FIG. 1, FIG. 3 is a sectional view showing an arrangement of the heat exchanger when used as an evaporator of a cooler.

DESCRIPTION OF THE PREFERRED EMBODIMENTS

Figure 5A:
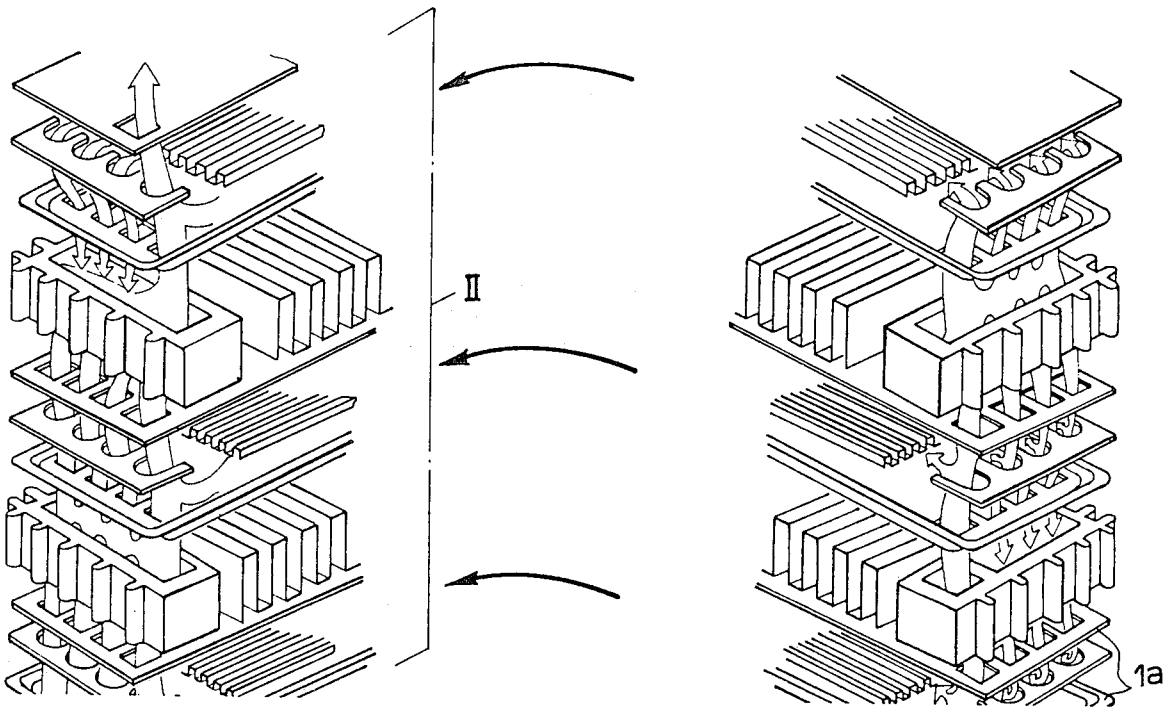
Figure 5B:
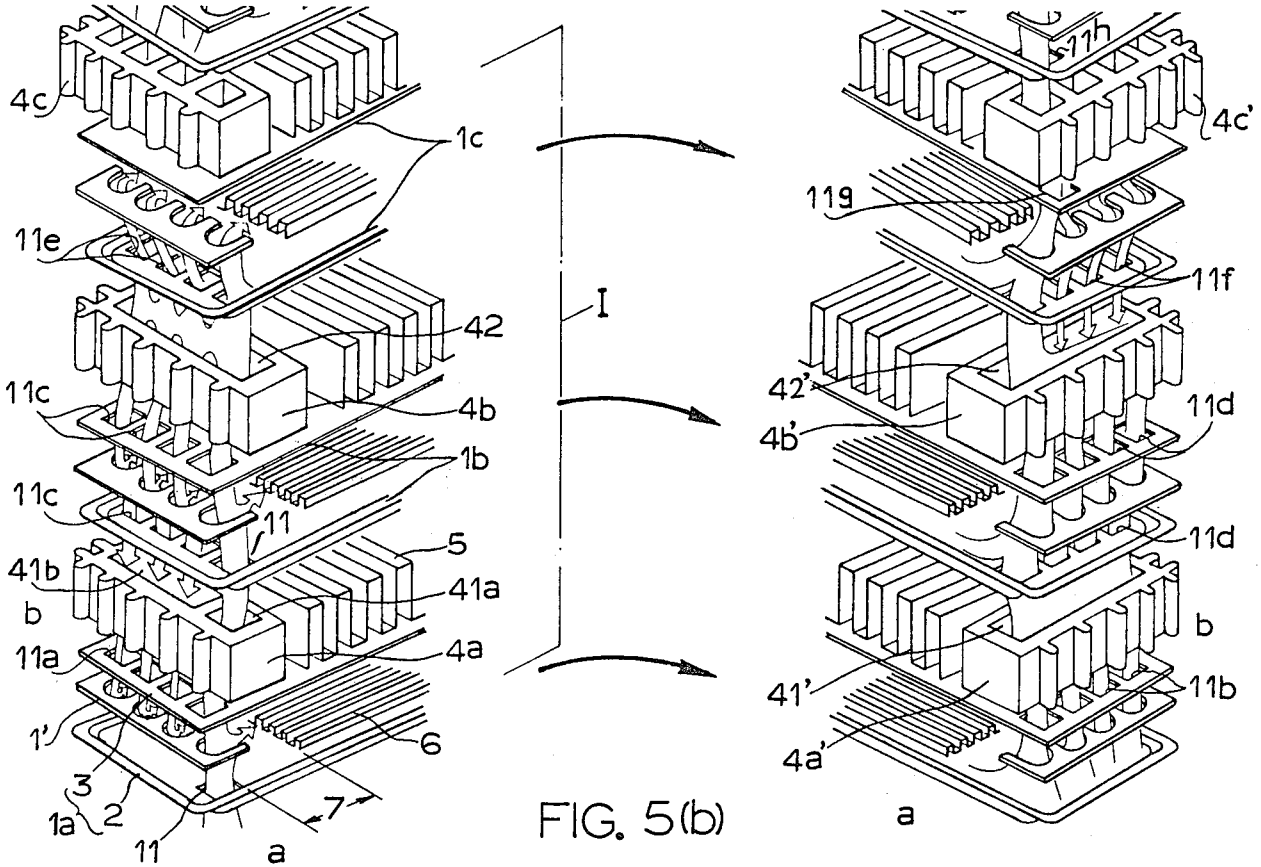

FIG. 5 is an exploded perspective view showing the first embodiment of a heat exchanger in accordance with the present invention, and the embodiment has a structure in which one unit of three stages of tubes constitutes one passage for the refrigerant. In the drawings, the same numerals as FIGS. 1 and 2 are used for identifying the same part. Reference (a) designates an air-inlet side and (b) an air-outlet side.

The lowermost tube 1*a* of each tube unit has a refrigerant inlet opening 11 and common openings 11*a* at the refrigerant inlet side and has common openings 11*b* at the refrigerant outlet side. The refrigerant inlet opening 11 is provided in the lower-side plate 2 at a portion adjacent the air inlet side (a). Common openings 11*a* and 11*b* are provided in the upper-side plate 3. The middle tube 1*b* has an inlet opening 11 like the tube 1*a* and has common openings 11*c* and 11*d* provided in the upper and lower plates 3, 2 respectively at the opposite inlet and outlet sides. The upper tube 1*c* has common openings 11*e*, 11*f* in the lower plate 2 at the opposite refrigerant inlet and outlet sides and has an outlet 11*g* in the upper plate 3 at the refrigerant outlet side adjacent the air inlet side (a).

A spacer block 4*a*which is interposed between the tube 1*a* and the tube 1*b* of the second stage, has an opening 41*a* corresponding to the openings 11 and partitioned from the other openings 41*b* in the spacer block. A spacer block 4*b*, which is interposed between the tube 1*b* of the second stage and the tube 1*c* of the third stage, has a refrigerant flow passage 42 which is provided without partition throughout from the side (a) to the side (b). In these drawings, as has been conventionally provided, an end reinforcement plate 1' is disposed between the plates 2 and 3 to prevent the distortion of the plates when the tube 1*a* is assembled by brazing together with the plates 2, 3, and an inside fin 6 is provided between the plates 2 and 3 in the direction of the refrigerant flow.

Thus, the refrigerant entering from the refrigerant inlet opening 11 of the first stage tube 1*a* passes through the passage 41*a* of the spacer block 4*a* and the passage 42 of the spacer block 4*b*. Therefore, the refrigerant flows mainly in a portion of each tube 1*a*, 1*b* and 1*c* adjacent the air inlet side (a) of the first passage I. Since the inside fin 6 is not provided in a range 7 adjacent the refrigerant inlet side of the fin 6, refrigerant entering through the inlet opening 11 flows also to the air outlet side (b). Further, the refrigerant flowing into the spacer block 4b spreads out the full length of the passage 42 of the spacer block 4b because no partition is provided in the passage 42 and flows downwardly through the passage 41b of the spacer block 4a at the air outlet side (b). Thus, the refrigerant passes also in the air outlet side (b) through tubes 1a, 1b and 1c of each stage. In the air outlet side (b), the amount of refrigerant is small and therefore the dynamic pressure of the refrigerant is low comparing with those in the air inlet side (a) where the refrigerant passes at a relatively high speed. This refrigerant flowing condition is kept through the stages by means of the inside fins 6 provided in the tubes.

In the refrigerant outlet side, spacer blocks 4a' and 4b' have full length openings 41' and 42' respectively for the refrigerant to pass therethrough, so that the refrigerant which has passed through each tube 1a, 1b, 1c, mixes with each other in the passages 41' and 42' of the spacer blocks 4a' and 4b'.

The first unit of the tube assembly I communicates with the second unit the tube assembly II through spacer blocks 4c and 4c'.

Refrigerant flowing through the second unit the tube assembly II which comprises a unit of three stages, like the refrigerant flowing through the first unit of tube assembly I, enters from a refrigerant inlet opening 11h provided only in the air inlet side.

Figure 4:
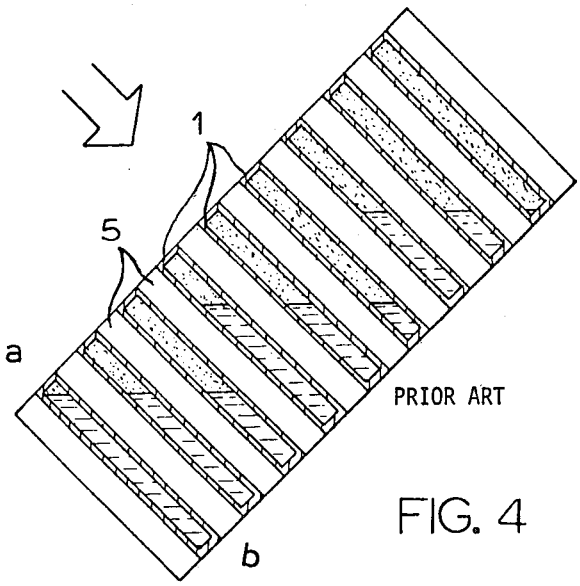
FIG. 4 is a sectional view showing gas-liquid distribution in the refrigerant passage in the conventional heat exchanger, FIGS. 5(*a*) and 5(*b*) are exploded perspective views showing principal parts of a first embodiment of the heat exchanger in accordance with the present invention.
Figure 6:
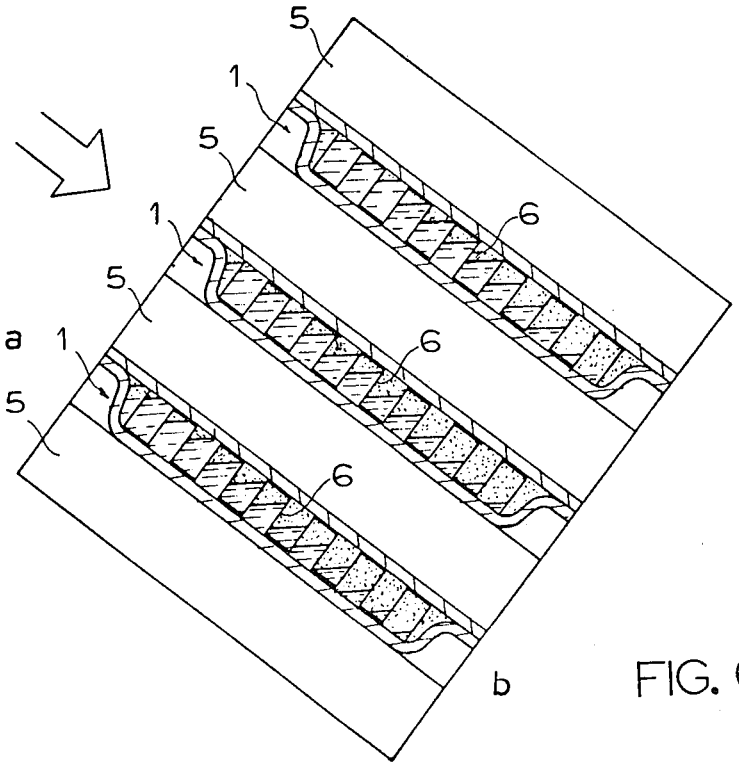
FIG. 6 is a sectional view showing a gas-liquid distribution in a refrigerant passage in accordance with the present invention, and, FIGS. 7 and 8 are perspective views respectively explaining principal parts of second and third embodiments in accordance with the present invention.

Because the second unit of the tube assembly II has the same construction as the first unit of the tube assembly I at the refrigerant inlet and outlet sides, refrigerant of the gas and the liquid phases which mixes together at the refrigerant outlet side of the first unit of the tube assembly I enters through the refrigerant inlet opening 11h into the second unit of the tube assembly II. The gas phase of the refrigerant flows into th air outlet side (b) of low dynamic pressure, and the liquid phase of the refrigerant flows mainly into the air inlet side (a). In the tubes of each stage, the liquid-gas distribution is maintained by the inside fins 6, mixed up again in the refrigerant outlet side. A similar process is repeated in the third passage unit of the tube assembly. Thus, as shown in FIG. 6, the unevaporated liquid refrigerant mainly passes through a portion adjacent the air-inlet side (a) where the temperature difference between the air and the refrigerant is large, and mainly gas refrigerant passes in a portion near the air outlet side (b) where the temperature difference is small. Thus, the liquid refrigerant is distributed in proportion to the temperature difference between the air and the refrigerant, which can greatly improve the heat exchange efficiency of the heat exchanger.

A cooler which is used in a temperature range about 15°–20° C. of the air leaving the device has also same gas-liquid distribution, even if the amount of the circulating refrigerant decreases at a low temperature. That is, gaseous refrigerant mainly flows in the air outlet side (b) where it is easily frosted, so that the frost-starting temperature of the air entering the device is remarkably low relative to the conventional type thereby preventing the lowering of the function in a temperature range.

Further, since the refrigerant which has passed through the tube is mixed in the refrigerant outlet side before entering the next passage, the gas-liquid distribution of the refrigerant in each passage may be kept constant. Thus, a constant heat exchange efficiency may be maintained.

Figure 7:
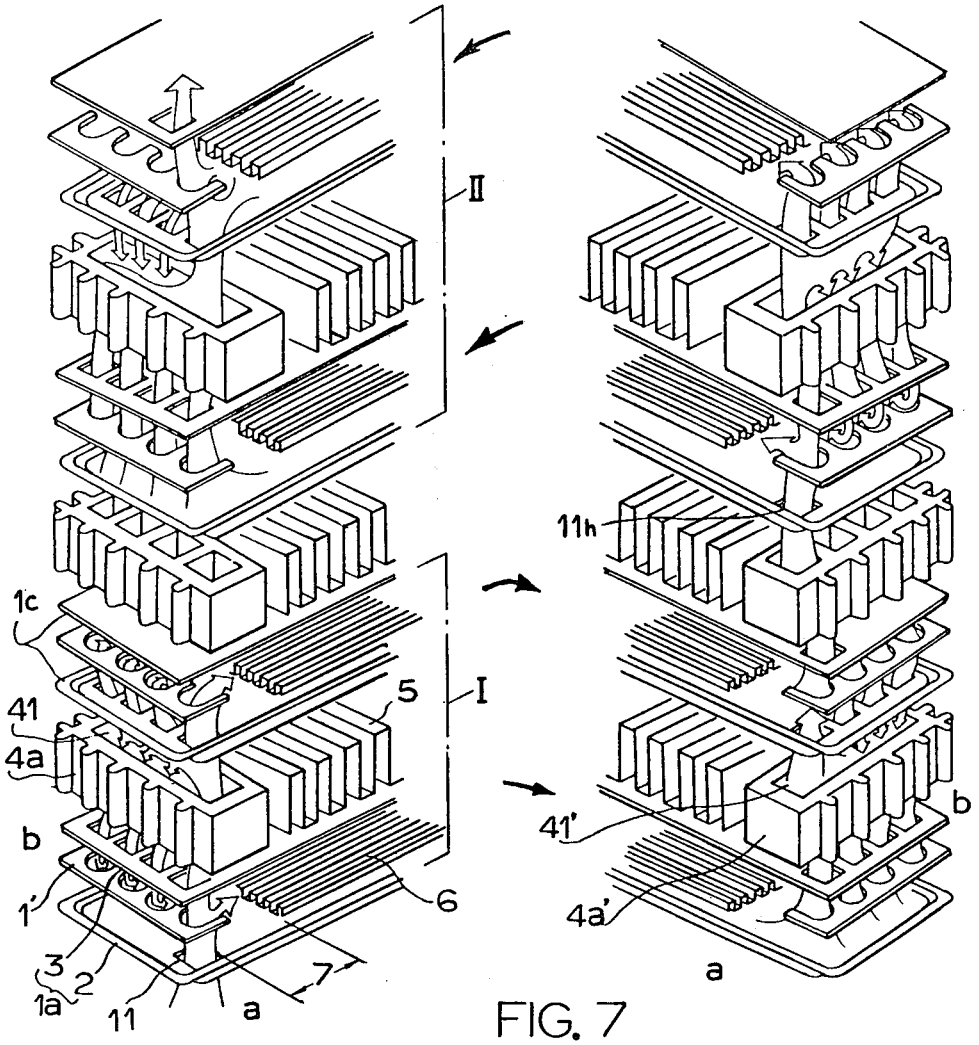

FIG. 7 shows a structure of a refrigerant passage comprising two stages of tubes. In this embodiment, the structure is the same as a part of the structure shown in FIG. 5, where refrigerant also enters only from the refrigerant inlet opening 11 provided in the air inlet side (a), and is mixed in the spacer block 4a' provided in the refrigerant outlet side. Therefore, the function of this embodiment is also the same. However, since in each passage, only one spacer block is provided in one stage, the passage 41 of the spacer block 4a in the refrigerant inlet side has the same structure as the spacer block 4b of the second stage of FIG. 5. Therefore, the refrigerant expands in the full length of the passage 41 in the spacer block 4a and flows downwards at the air outlet side (b).

Figure 8:
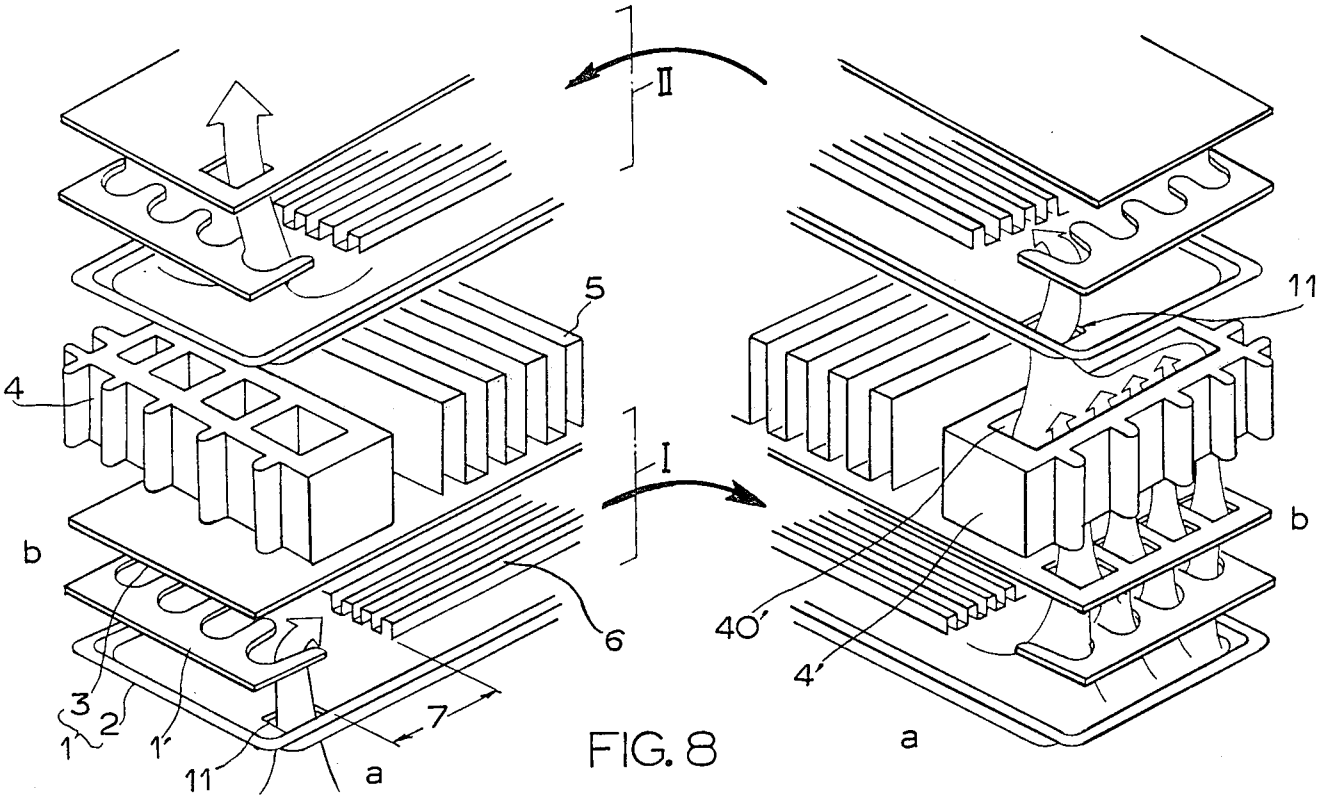

In FIG. 8, one passage formed by one tube 1 is applied to the present invention. In this embodiment, at the refrigerant inlet side, refrigerant entering through the refrigerant inlet opening 11 of air-inlet side (a) expands in full length only in the range 7 before the inside fin 6, thereby flowing also into the portion in the air outlet side (b). At the refrigerant outlet side, refrigerant in the gas-liquid phase is mixed and stirred with each other in the passage 40' of the spacer block 4' which is interposed between the adjacent refrigerant passages. This arrangement has a similar function to the arrangements shown in FIGS. 5 and 7.

Therefore, this invention can provide a heat exchanger of the layered plate-fin type having a gas-liquid distribution proper for an operation with a high heat exchange efficiency having an effective function preventing frosting. This type of heat exchanger is light, small, highly efficient and practical, and can be applied as an evaporator of various kinds of coolers.

What is claimed is:

1. In a heat exchanger having a plurality of layered tube units for refrigerant in a gas phase and a liquid phase, the tube units being disposed substantially one above the other, each of the tube units comprising at least one tube made of two elongated plates and having a refrigerant inlet side and a refrigerant outlet side at opposite elongated ends, and spacer blocks disposed between said tubes of said tube units forming air passages between said tubes of said tube units, said air passages having an air inlet side and an air outlet side, adjacent upper and lower of the tube units being alternately arranged in relation to respective said refrigerant inlet and outlet sides, said spacer blocks defining refrigerant flow passages between said tubes of each said tube units and respectively between alternately arranged respective and said refrigerant inlet and outlet sides of said adjacent upper and lower of the tube units, the improvement wherein each of said at least one tube of a common of said tube units has said refrigerant inlet and outlet sides on common sides respectively and constitutes means for the refrigerant to flow therethrough in the same direction defining a single refrigerant tubular passage in said common tube unit, a single refrigerant inlet opening formed in a lower most of said plates in each of said tube units at said refrigerant inlet side and adjacent said air inlet side, at least one refrigerant outlet opening formed in an uppermost of said plates of said tube units, respectively, at the refrigerant outlet side of each said tube units, an elongated inside fin disposed in each said tube dividing said tube cross-sectionally in width into a plurality of elongated separated channels for guiding refrigerant flow from said refrigerant inlet side to the refrigerant outlet side, and said inside fin in the lowermost of said tubes is spaced from sad inlet opening and said refrigerant inlet side leaving a free space between said refrigerant inlet opening and said refrigerant inlet side, respectively, and said inside fin, at least one of said spacer blocks is formed with only one of said refrigerant flow passages extending substantially from said air inlet side to said air outlet side constituting means for spreading out and mixing the refrigerant flowing upwardly therethrough and for passing downwardly flowing portions of the refrigerant at said air outlet side, such that there is a refrigerant distribution with most of the refrigerant flowing in the tubes adjacent said air inlet side, with the gas phase primarily at said air outlet side and the liquid phase primarily at said air inlet side, and said inside fins maintaining said distribution in said tubes.

2. The heat exchanger according to claim 1, wherein said each tube unit comprises at least two tubes, each of said tubes in said plates at the refrigerant inlet side and the refrigerant outlet side defining common openings, and said spacer blocks comprise, a plurality of said at least one of said spacer blocks each disposed between said tubes of each of said tube units at the refrigerant inlet side and the refrigerant outlet side, with said only one refrigerant flow passage communicating with said common openings in said plates of upper and lower adjacent of said tubes in said each of said tube units, another of said spacer blocks disposed between said alternately arranged respective said refrigerant inlet and outlet sides of said adjacent upper and lower tube units, said refrigerant flow passages of said another spacer blocks communicate said at least one refrigerant outlet opening of the lower of said tube units with said single refrigerant inlet opening of the adjacent upper of said tube units, respectively.

3. The heat exchanger according to claim 2, wherein said at least on refrigerant outlet opening comprises a single refrigerant outlet opening adjacent said air inlet side.

4. The heat exchanger according to claim 3, wherein said refrigerant flow passage of said another spacer block has a cross-secton substantially equal to that of its communicating said single refrigerant inlet and outlet openings.

5. The heat exchanger according to claim 2, 3, or 4, wherein said each tube unit comprises three tubes, said spacer blocks include still another of said spacer blocks between the lowermost of said tubes of said each tube unit and the centermost of said tubes of said each tube unit at said refrigerant inlet side, said still another spacer block being partitioned forming a first and a second of said refrigerant flow passages therethrough, said first refrigerant flow passage communicates with an inlet opening of said centermost tube adjacent said air inlet side at said refrigerant inlet side and one of said common openings in said lowermost tube at said refrigerant inlet side adjacent said air inlet side, and said second refrigerant flow passage communicates with said common openings in said centermost tube at said refrigerant inlet side and the remaining of said common openings in said lowermost tube at said refrigerant inlet side, whereby refrigerant flows downwardly through said second refrigerant flow passage at said air outlet side.

6. The heat exchanger according to claim 1 or 2, wherein said inside fins in each of said tubes have ends spaced from said refrigerant inlet and outlet sides, respectively.

7. The heat exchanger according to claim 1, wherein the refrigerant in said air outlet side has a lower dynamic pressure relative to that at said air inlet side.

8. The heat exchanger according to claim 1, wherein the temperature difference between the air and the refrigerant is larger at said air inlet side than at said air outlet side.

9. The heat exchanger according to claim 1, wherein said tube units are mounted in a tilted condition.

10. The heat exchanger according to claim 1, wherein said each tube unit comprises one tube, said at least one refrigerant outlet opening comprises a plurality of outlet openings, said at least one spacer block is a single spacer block disposed between said alternately arranged respective said refrigerant inlet and outlet sides of said adjacent upper and lower tube units, said only one refrigerant flow passage of said single spacer block communicates said plurality of refrigerant outlet openings of said lower tube unit with said single refrigerant inlet opening of the adjacent upper tube unit.

11. The heat exchanger according to claim 10, wherein said only one refrigerant flow passage in said single spacer block mixes said refrigerant in the refrigerant outlet side of said lower tube unit before entering the adjacent upper refrigerant tubular passage in the adjacent upper tube unit, whereby the gas-liquid distribution of the refrigerant in each higher said refrigerant tubular passage is kept constant providing a constant heat exchange efficiency.

12. The heat exchanger according to claim 3, wherein said refrigerant flow passage in said another spacer block mixes said refrigerant in the refrigerant outlet side of the lower tube unit before entering the adjacent upper refrigerant tubular passage in the adjacent upper tube unit, whereby the gas-liquid distribution of the refrigerant in each higher said refrigerant tubular passage is kept constant providing a constant heat exchange efficiency.

* * * * *

UNITED STATES PATENT AND TRADEMARK OFFICE

CERTIFICATE OF CORRECTION

PATENT NO. : 4,379,486
DATED : April 12, 1983
INVENTOR(S) : Tetsuo Kurihara

It is certified that error appears in the above-identified patent and that said Letters Patent are hereby corrected as shown below:

Claim 1 Column 4, Line 48 delete "and" first occurrence

Line 57 change "lower" to --lower- --

Line 58 delete "in" and insert --of--

Column 5, Line 2 change "sad" to --said--

Claim 12 Column 6, Line 51 delete "3" and insert --2--

Signed and Sealed this

Ninth Day of August 1983

[SEAL]

*Attest:*

*Attesting Officer*

GERALD J. MOSSINGHOFF

*Commissioner of Patents and Trademarks*